United States Patent [19]

Heitzman

[11] 4,068,996

[45] Jan. 17, 1978

[54] APPARATUS FOR MOLDING CONCRETE ARTICLES AND THE LIKE

[75] Inventor: Charles J. Heitzman, Honolulu, Hawaii

[73] Assignee: William J. Shannon, Miliani Town, Hawaii ; a part interest

[21] Appl. No.: 725,634

[22] Filed: Sept. 22, 1976

[51] Int. Cl.[2] ..... B28B 21/90

[52] U.S. Cl. ..... 425/253; 425/441; 425/452

[58] Field of Search ..... 425/253, 441, 452

[56] References Cited

U.S. PATENT DOCUMENTS

| | | | |
|---|---|---|---|
| 2,460,167 | 1/1949 | Carlsen | 425/441 |
| 2,663,063 | 12/1953 | Van Loon | 425/436 X |
| 3,176,371 | 4/1965 | Patchen | 425/253 |

*Primary Examiner*—Richard B. Lazarus

*Attorney, Agent, or Firm*—Jacox & Meckstroth

[57] ABSTRACT

A mold box carries a removable pallet and is supported for tilting movement between a generally vertical filling position and a generally horizontal stripping position. In the filling position, the mold box receives a self-hardening material such as concrete to form a molded article. In the stripping position, the pallet and the molded article are pulled from the mold box onto a horizontal platform by a pulling member guided along the platform and connected to a fluid cylinder mounted on the platform. The pulling member connects with an arm member disposed within the mold box under the pallet when the mold box moves to its stripping position. The mold box is also disclosed with a plurality of parallel spaced core members, and the upper or outer ends of the core members are supported by pivotally retractable core support members.

19 Claims, 8 Drawing Figures

APPARATUS FOR MOLDING CONCRETE ARTICLES AND THE LIKE

BACKGROUND OF THE INVENTION

In a machine for molding a self-hardening material such as concrete for successively producing elongated molded articles, it has been found desirable to incorporate an elongated mold box which carries a removable liner or pallet and is movable between a vertical position for receiving the moldable material and a horizontal position where the molded article is stripped along with the liner or pallet from the mold box and moved onto a horizontal receiving platform or run-out table. Such machines are disclosed in U.S. Pat. Nos. 3,303,545, and 3,624,825 which issued to Applicant.

In the former patent, the molded article is ejected with its liner from the mold box onto a receiving platform by means of a pusher plate which is pushed through the mold by the extension of the piston rod of a fluid cylinder supported adjacent the molding machine on the side opposite of the receiving platform. Similarly, in the molding machine disclosed in U.S. Pat. No. 2,663,063, a molded article is ejected from a tilting mold box by first retracting a set of core members from the article with a fluid cylinder and then using the core members to push the molded article from the mold box onto a receiving platform or table. In Applicant's U.S. Pat. No. 3,624,825, the tilting mold box of the molding machine incorporates or carries with it a fluid cylinder which is extended when it is desired to strip each molded article from the mold box.

It has been found desirable to minimize the floor space required by a molding machine or apparatus of the type disclosed in the above patents. While the machine disclosed in above mentioned U.S. Pat. No. 3,624,825 provides this desirable feature by incorporating a fluid cylinder within the tiltable mold box for stripping each article, the stripping cylinder is subjected to substantial vibration while the concrete or material is being condensed within the mold box by vibrators mounted on the mold box. As a result, additional maintenance is required by the fluid cylinder which is not only difficult to maintain but is also difficult to keep clean. Furthermore, when a mold box has substantial length, the fluid stripping cylinder also has a corresponding length. However, when a long piston rod is extended for stripping an article from the mold box, the piston rod tends to wander as it is extended, resulting in substantial bending forces being exerted on the extended piston rod.

SUMMARY OF THE INVENTION

The present invention is directed to an improved machine or apparatus for molding articles of concrete or other self-hardening moldable material and which is particularly adapted for molding articles having substantial length while minimizing the floor space required by the apparatus. The apparatus of the invention also eliminates the problems mentioned above in connection with the molding machine disclosed in U.S. Pat. No. 3,624,825 and is adapted to be operated over an extended period of time with a minimum of maintenance. The apparatus of the invention further provides for efficiently producing cored articles of self-hardening material by incorporating improved means for supporting a series of cores within the mold box and for releasing the cores to simplify stripping of each molded article from the mold box.

Other features and advantages of the invention will be apparent from the following detailed description, the accompanying drawings and the appended claims.

DESCRIPTION OF THE PREFERRED EMBODIMENT

Figure 1:
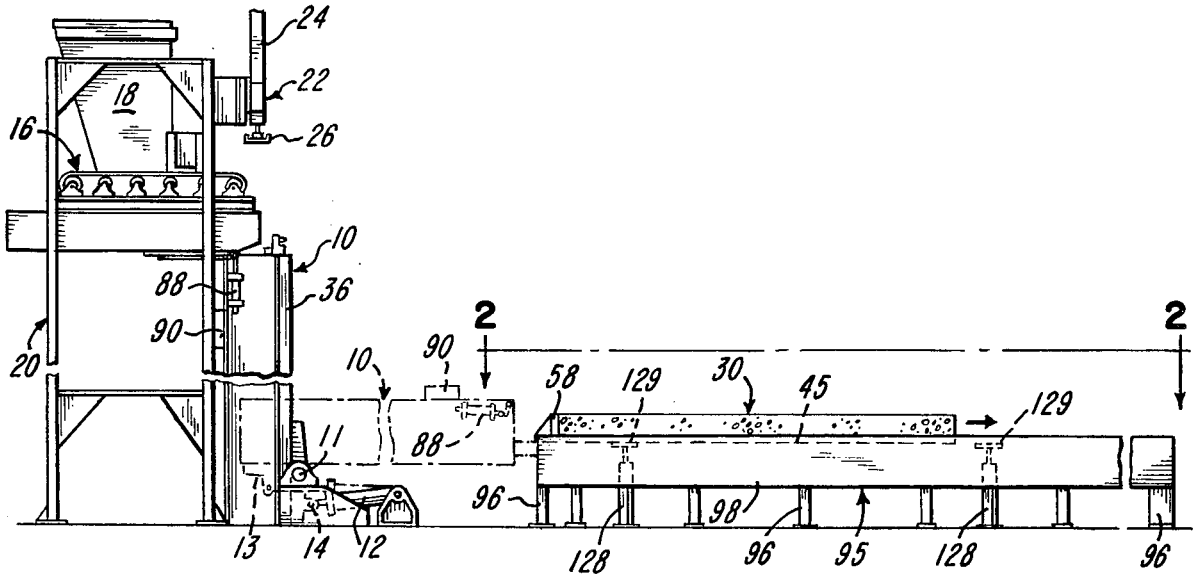
FIG. 1 is a somewhat schematic side elevational view of molding apparatus constructed in accordance with the invention and illustrating a pallet supported molded article after it is stripped from the mold box and placed on a receiving platform.

The apparatus illustrated in the drawings is adapted for successively producing or molding cored articles of concrete, but other self-hardening material may also be used. The apparatus includes an elongated mold box 10 which is pivotally supported by trunnions 11 for tilting movement between a generally vertical filling position, as illustrated in full lines in FIG. 1, and a generally horizontal stripping position, as illustrated by the broken lines in FIG. 1. The mold box 10 is moved or shifted between its filling and stripping positions by actuation of a fluid or hydraulic cylinder 12 having a piston rod pivotally connected to an arm 13 on the mold box by a pin 14.

When the mold box is tilted to its vertical filling position, mixed concrete material is supplied to the upper or outer end of the mold box by an endless feed conveyor 16 which extends horizontally under the bottom outlet of a material supply hopper 18. The conveyor 16 and supply hopper 18 are supported by a fabricated steel frame 20 and are sufficiently elevated so that the material falls by gravity from the conveyor 16 into the upper open end of the mold box 10. As also illustrated in the above mentioned U.S. Pat. No. 3,624,825, a tamper assembly 22 is supported by the frame 20 above the mold box 10 in a vertical alignment and includes a fluid cylinder 24 connected to a tamper plate 26 for tamping or packing the concrete material into the mold box 10.

Figure 6:
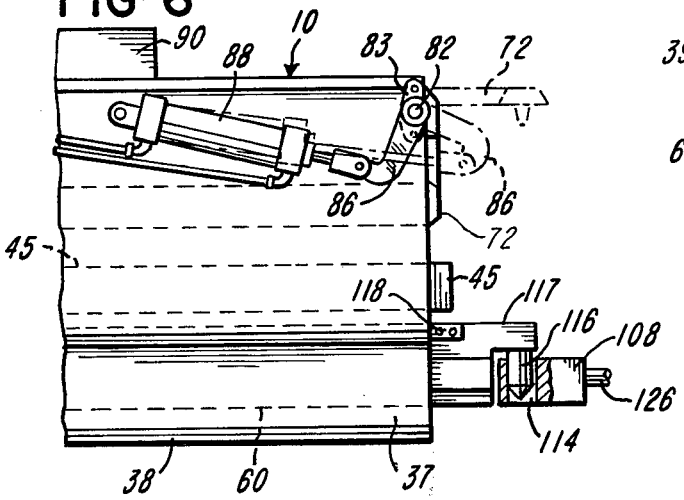
FIG. 6 is a fragmentary side elevational view of the front or outer end portion of the mold box and illustrating by broken lines the core support members in their retracted positions.
Figure 7:
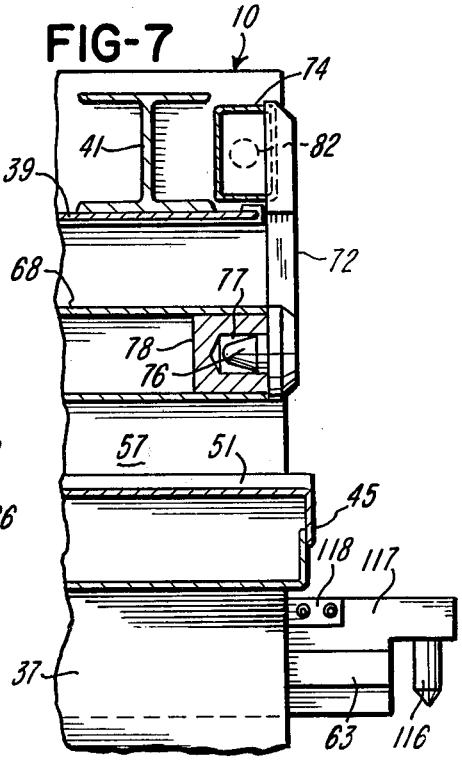
FIG. 7 is an enlarged fragmentary section of the outer end portion of the mold box as taken generally on the line 7—7 of FIG. 5.
Figure 8:
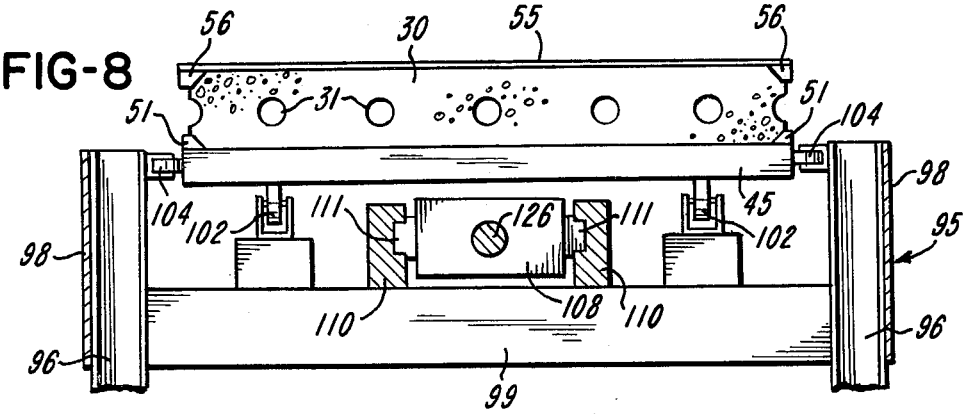
FIG. 8 is an enlarged fragmentary section of the receiving table or platform as taken generally on line 8—8 of FIG. 2.

Referring to FIG. 8, the mold box 10 is constructed to form an elongated and generally flat concrete slab 30 having a plurality of parallel spaced and longitudinally extending core openings 31. However, it is to be understood that the mold box 10 may be constructed to provide for forming or molding other articles of concrete or self-hardening material. As shown in FIGS. 3–7, the mold box 10 includes a pair of longitudinally extending side frame channels or members 34 which are rigidly secured to a fabricated steel base 36 which includes a plurality of parallel spaced beams 37 sandwiched between upper and lower metal plates 38. The mold box 10 also includes an upper flat wall 39 (FIG. 4) which is rigidly secured to a plurality of longitudinally spaced across beams 41 rigidly connecting the side frame members 34. The cross beams 41 are reinforced by corresponding ribs 43 to provide the upper wall 39 with substantial strength.

The mold box 10 is adapted to receive a rectangular pallet 45 (FIGS. 4 and 5) which is preferably constructed of formed interfitting sheet metal sections. The pallet 45 is supported within the mold box by a series of parallel rails 46 which are mounted on the base 36. A series of guide rollers 48 are mounted on each of the side frame members 34 at longitudinally spaced intervals for guiding the pallet 45 into and out of the mold box. These guide rollers may have resilient outer surfaces and be driven to facilitate moving the pallets in and out of the mold box. A set of chamfer forming rails or elements 51 (FIG. 8) are secured to the top surface of the pallet 45 and are positioned to abut a corresponding pair of longitudinally extending edge form members 52 which are removably secured to the side frame members 34 of the mold box 10 by a set of screws.

In addition to a pallet 45, the mold box 10 is adapted to receive a flat rectangular liner plate 58 (FIG. 8) which corresponds in size to the pallet 45. The liner plate 55 is positioned adjacent the upper wall 39 of the mold box by the edge formed members 52 which also abut a set of longitudinally extending chamfer forming rails or elements 56 secured to the liner plate 55. The liner plate 55 cooperates with the edge form members 52 and the pallet 45 to define a cavity 57 (FIG. 4) having an open upper end for receiving the concrete material from the feed conveyor 16. The lower end of the cavity is closed by an ejector or push plate 58 (FIG. 4) which is rigidly secured to one end portion of an elongated mold box arm 60.

The arm 60 extends longitudinally within the base 36 of the mold box 10 under the pallet 45 and is slidably supported by a pair of parallel spaced tracks 62 (FIG. 5) which slidably receive corresponding rails 63 projecting outwardly from the arm 60. A set of brackets 66 (FIG. 4) reinforce the push plate 58 which is provided with a series of circular holes for receiving a corresponding series of elongated core members or tubes 68 which extend longitudinally within the mold box cavity 57. The inner ends of the core tubes 68 are supported by a cross beam or member 71 (FIG. 4) which is rigidly connected to the side frame members 34. The outer or upper ends of the core tube 68 are supported by a corresponding series of core support arms 72 which are rigidly secured to a cross support tube 74 (FIG. 7) in parallel spaced relation. Each of the core support arms 72 includes a projecting tapered stud 76 (FIG. 7) which is adapted to be received within a mating hole 77 formed within the center of a plug member 78 inserted into the outer end portion of the corresponding core tube 68.

The core support arms 72 and their connecting cross support tube 74 are pivotally supported by a set of trunnions 82 (FIGS. 5–7) which are rotatably supported within corresponding bearings 83 secured to the side frame members 34. A crank arm 86 (FIG. 6) is secured to the outer end portion of one of the trunnions 82 and is pivotally connected to the piston rod of a fluid or hydraulic cylinder 88 pivotally supported by the corresponding side frame members 34. As illustrated in FIGS. 6 and 7, actuation of the cylinder 88 is effective to shift the core support arms 72 as a unit between core supporting positions (FIG. 7) and retracted positions illustrated by the dotted lines in FIG. 6. The mold box 10 also carries a set of electrically actuated vibrators 90 which function to consolidate the concrete received within the cavity 57 and to eliminate voids within the concrete.

Figure 2:
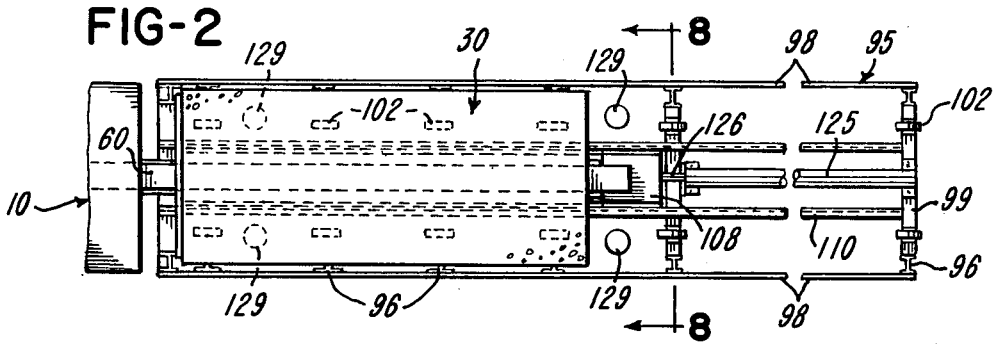
FIG. 2 is also a somewhat schematic fragmentary plan view of the receiving platform as taken generally on the line 2—2 of FIG. 1, and showing the stripping mechanism associated with the platform.
Figure 3:
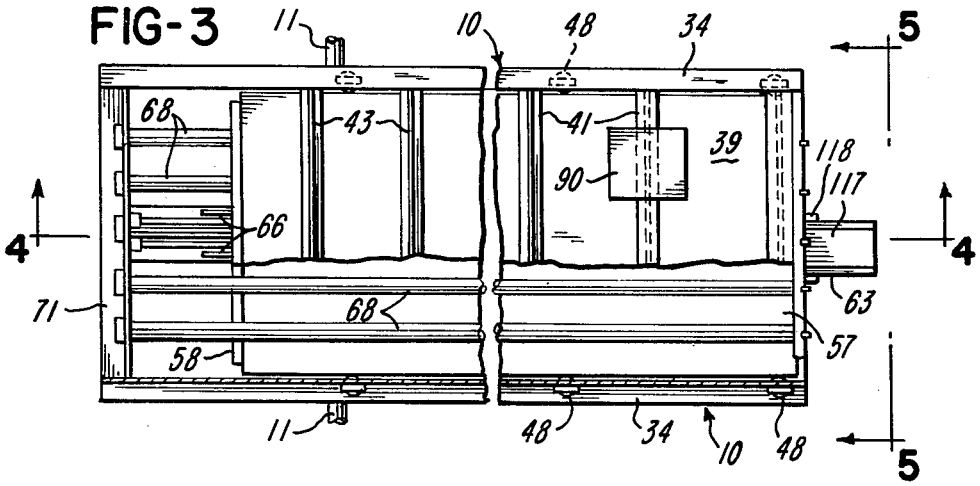
FIG. 3 is a fragmentary plan view on a somewhat larger scale of the mold box forming part of the apparatus shown in FIG. 1 and with portions broken away to show the internal core members.
Figure 4:
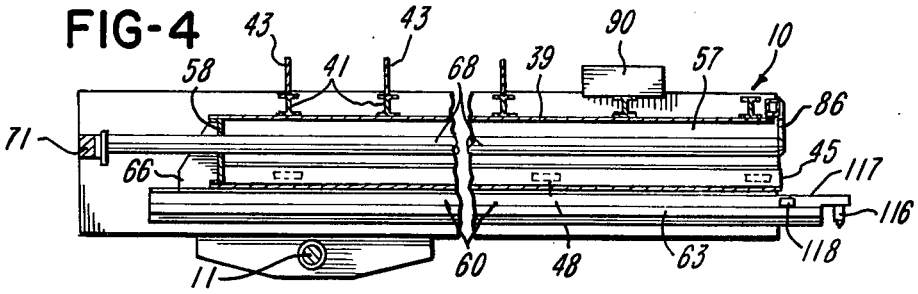
FIG. 4 is a vertical section taken generally on the line 4—4 of FIG. 3.
Figure 5:
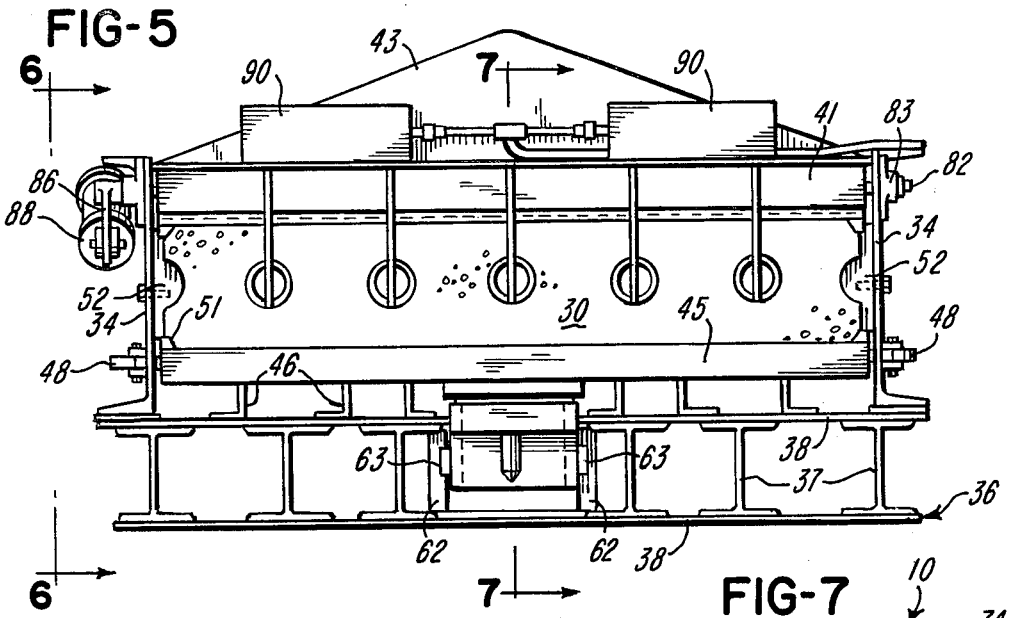
FIG. 5 is a somewhat enlarged end view of the mold box and taken generally on the line 5—5 of FIG. 3.

Referring to FIGS. 1, 2 and 8, an elongated generally horizontal run-out table or platform 95 is positioned adjacent the mold box 10 in its stripping position to receive each pallet supported article or slab formed within the box. The table or platform 95 includes a series of longitudinally spaced support legs 96 which are rigidly connected by longitudinally extending side frame plates or members 98 and laterally extending cross-frame members 99 (FIG. 8). A series of longitudinally spaced pairs of rollers 102 (FIG. 8) are supported by the cross frame members 99, and the rollers 102 are adapted to engage the bottom surface of a pallet 45 as the pallet is removed from the mold box 10 with a partially set concrete slab 30. The table legs 96 also support a series of longitudinally spaced pairs of opposing guide rollers 104 (FIG. 8) which also engage and guide each pallet 45 as it is removed from the mold box so that the pallet is confined to a precise linear path as the pallet is shifted from the mold box 10 on the run-out table or platform 95. The support rollers 102 and/or the guide rollers 104 may be power driven to provide for feeding an empty pallet 45 into the mold box 10, as will be explained later.

A pulling or coupling member 108 (FIGS. 2 and 6) is supported for horizontal linear movement along the run-out platform 95 by a pair of longitudinally extending guide tracks 110 which have opposing slots for slidably receiving a pair of rails 111 projecting laterally from opposite sides of the coupling member 108. The tracks 110 in the run-out platform 95 align with the corresponding tracks 62 within the base 36 of the mold box 10, but are sufficiently spaced to allow arm 60 to pass vertically between the tracks 110.

As shown in FIG. 6, the coupling member 108 has a vertically extending hole 114 which is adapted to receive a connecting pin 116 projecting downwardly from an extending outer end portion 117 of the mold box arm 60. When the mold box 10 is tilted from its filling position to its stripping position, the pin 116 moves into the hole 114 of the coupling member 108. A set of stop elements 118 are secured by screws to the arm 60 and may be adjustably positioned along the length of the arm to limit the movement of the arm 60 into the mold box according to the length of the article being molded. The coupling member 108 is shifted horizontally along the run-out table or platform 95 within the tracks 110 by an elongated fluid or hydraulic cylinder 125 (FIG. 2) which is supported by a set of the cross frame members 99. The cylinder 125 has a piston rod 126 which is connected to the coupling member 108.

A set of vertical fluid cylinders or hydraulic jacks 128 (FIG. 1) are positioned under the run-out platform 95 and include corresponding piston rods which support lifting pads 129. The hydraulic jacks 128 provide for elevating a pallet 45 and its supported concrete slab 30 above the elevation of the support rollers 102 and the legs 96 when the hydraulic jacks are actuated together.

After an article or concrete slab 30 is formed within the mold box 10 in its vertical position and the concrete is consolidated by actuation of the vibrators 90, the mold box 10 is tilted to its horizontal position by actuation of the hydraulic cylinder 12. Before the mold box 10 is tilted, the piston rod 126 of the fluid cylinder 125 is extended so that the pin 116 lowers into the hold 114 of the extended coupling member 108, as mentioned above. The core support arms 72 are then retracted by extension of the fluid cylinder 88, and the fluid cylinder 125 is actuated to retract the piston rod 126 so that the coupling member 108 pulls the mold box arm 60 from the mold box 10 onto the run-out platform 95. As the arm 60 is pulled out of the mold box 10, the arm and push plate 58 pull or strip the molded concrete article or slab 30 from the mold box cavity 57 along with its supporting pallet 45 and its overlying liner plate 55.

After the pallet 45, top liner plate 55 and a formed slab 30 are stripped from the mold box 10, the pallet, top liner plate 55 and slab are rolled along the run-out platform 95 onto a conveyor or another roller table which forms an extension of the run-out platform 95 and extends to a final curing area. The pallet 45 and the supported concrete slab 30 may also be elevated by actuation of the hydraulic jacks 128 so that the pallet and the slab may be picked up by a fork lift truck or other transport system.

From the drawings and the above description, it is apparent that apparatus constructed in accordance with the present invention, provides desirable features and advantages. For example, the construction and cooperation of the mold box 10 and of the run-out platform 95 provide for precisely stripping each partially set-up article from the mold box and depositing the article and its supporting pallet onto the run-out platform. That is, not only is the mold box arm 60 guided along a precise linear path by the tracks 62 as each pallet and molded article are stripped from the mold box, the pallet 45 is also precisely guided by the guide rollers 48 and 104. This assures that each molded article is stripped from the edge form members 52 and the core tubes 68 without any distortion or cracks developing in the molded article. As another important feature, the pulling or stripping cylinder 125 is removed from operating within the mold box 10 and is located in a cleaner environment to minimize servicing of the cylinder 125. In addition, the long piston rod 126 of the cylinder 125 is being retracted during the stripping operation, thereby placing the piston rod 126 in tension. This not only provides for minimizing maintenance and servicing of the cylinder 125, but also assures precision linear movement and stripping of each molded article from the mold box 10.

While the form of molding apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. In apparatus for molding articles of self-hardening moldable material and including a mold box, means supporting said mold box for tilting movement between a generally vertical filling position and a generally horiziontal stripping position, means for supplying the moldable material to said mold box when in said filling position to form an article within said mold box, a mold box member carried by said mold box and movable relative to said mold box, and means forming a generally horizontal platform disposed for receiving a molded article from said mold box after said mold box is moved to said stripping position, the improvement comprising power operated stripping means associated with said platform and including a pulling member movable along said platform, means for releasably connecting said pulling member to said mold box member when said mold box is in said stripping position, and means for moving said pulling member along said platform for pulling said mold box member to effect stripping of a molded article from said mold box onto said platform.

2. Apparatus as defined in claim 1 wherein said connecting means comprise a pin element secured to one of said mold box and pulling members, and the other said member includes means defining an aperture for receiving said pin element.

3. Apparatus as defined in claim 1 wherein said platform includes generally horizontal guide means for guiding said pulling member along said platform.

4. Apparatus as defined in claim 1 wherein said power operated stripping means comprise an elongated fluid cylinder supported by said platform with a generally horizontal axis, and said fluid cylinder includes an extensible member connected to said pulling member.

5. Apparatus as defined in claim 1 including a pallet disposed within said mold box and movable in response to movement of said mold box member, and said pallet includes parallel spaced chamfer forming elements to define corresponding chamfer corners on the molded article.

6. In apparatus for molding articles of self-hardending moldable material and including a mold box defining a molding cavity, means supporting said mold box for tilting movement between a generally vertical filling position and a generally horizontal stripping position, means for supplying the moldable material to said mold box when in said filling position to form an article within said mold box, a removable pallet supported within said cavity, a stripping member supported by said mold box for linear movement, and means forming a generally horizontal platform disposed for receiving a pallet and a molded article from said cavity after said mold box is moved to said stripping position, the improvement comprising power operated stripping means associated with said platform and including a pulling member supported for movement along a generally horizontal path, means for releasably connecting said pulling member to said stripping member when said mold box is in said stripping position, and means for moving said pulling member along said linear path for pulling said stripping member and said pallet from said mold box to effect stripping of the molded article and its supporting pallet from said mold box cavity onto said platform.

7. Apparatus as defined in claim 6 wherein said mold box and said platform each has a series of horizontally opposing sets of guide rollers for said pallet, and said guide rollers on said platform are aligned with said guide rollers on said mold box when said mold box is in said stripping position.

8. Apparatus as defined in claim 6 wherein said platform includes means for guiding said stripping member on said mold box when said stripping member is extended from said mold box during a stripping operation.

9. Apparatus as defined in claim 6 wherein said means for moving said pulling member comprises an elongated generally horizontal fluid cylinder mounted on said platform and having a piston rod connected to said pulling member.

10. Apparatus as defined in claim 6 wherein said platform includes horizontally extending track means for guiding said pulling member along said linear path when an article is stripped from said mold box cavity.

11. Apparatus as defined in claim 6 wherein said mold box includes a push plate forming one end of said cavity and connected to move with said stripping member, at least one elongated core member extending within said cavity, and said push plate includes means defining an opening for slidably receiving said core member.

12. Apparatus as defined in claim 6 wherein said mold box includes at least one elongated core member extending within said cavity, at least one core support member associated with an end portion of said core member, and means supporting said core support member for movement between an extended position engaging said end portion of said core member and a retracted position which provides for stripping a molded article from said cavity and said core member.

13. In apparatus for molding articles of self-hardening moldable material and including a mold box, means supporting said mold box for tilting movement between a generally vertical filling position and a generally horizontal stripping position, means for supplying the moldable material to said mold box when in said filling position to form an article within said mold box, a mold box member carried by said mold box and movable relative to said mold box, and means forming a generally horizontal platform disposed for receiving a molded article from said mold box after said mold box is moved to said stripping position, the improvement comprising power operated stripping means associated with said platform and including a pulling member movable along said platform, means for releasably connecting said pulling member to said mold box member when said mold box is in said stripping position, means for moving said pulling member along said platform for pulling said mold box member to effect stripping of a molded article from said mold box onto said platform, said mold box including at least one core member having an end portion disposed adjacent a corresponding end portion of said mold box, a core support member, and means mounted on said end portion of of said mold box and supporting said core support member for pivotal movement between a supporting position engaging said end portion of said core member and a retracted position spaced from said core member to provide for stripping a molded article from said core member.

14. Apparatus as defined in claim 13 including a plurality of said core members disposed in parallel spaced relation, a corresponding plurality of said core support members, and means rigidly connecting said core support members for pivotal movement as a unit.

15. In apparatus for molding articles of self-hardening moldable material and including a mold box, means supporting said mold box for tilting movement between a generally vertical filling position and a generally horizontal stripping position, means for supplying the moldable material to said mold box when in said filling position to form an article within said mold box, a mold box member carried by said mold box and movable relative to said mold box, and means for forming a generally horizontal platform disposed for receiving a molded article from said mold box after said mold box is moved to said stripping position, the improvement comprising power operated stripping means associated with said platform and including a pulling member movable along said platform, means for releasably connecting said pulling member to said mold box member when said mold box is in said stripping position, means for moving said pulling member along said platform for pulling said mold box member to effect stripping of a molded article from said mold box onto said platform, said mold box member including an elongated arm member supported by said mold box for longitudinal movement, a pusher plate connected to one end portion of said arm member, and said connecting means couples the opposite end portion of said arm member to said pulling member.

16. Apparatus as defined in claim 15 wherein said platform includes track means for guiding said arm member along said platform, and a plurality of article guide rollers mounted on said platform and spaced with said track means therebetween.

17. In apparatus for molding articles of self-hardening moldable material and including a mold box defining a cavity, a removable pallet disposed within said cavity, means for supplying the moldable material to said mold box to form a molded article within said cavity, and means forming a generally horizontal platform disposed for receiving said pallet and the molded article from said mold box, the improvement comprising power operated stripping means associated with said platform and including a pulling member, generally horizontally extending track means connected to said platform and supporting said pulling member for reciprocating linear movement along said platform, an elongated arm supported by said mold box for reciprocating linear movement, said arm having an outer end portion and an inner end portion, means connected to said inner end portion of said arm for engaging and end of the article and operable to push the article during stripping, means for releasably connecting said pulling member to said outer end portion of said arm, said platform having means for receiving said arm when said arm is moved outwardly from said mold box, and power operated means for reciprocating said pulling member along said track for pulling said arm from said mold along a precise linear path to effect precise linear stripping of the pallet and the molded article from said mold box.

18. Apparatus as defined in claim 17 wherein said mold box includes at least one core member having an end portion, a core support member, and means supporting said core support member for movement between a supporting position engaging said end portion of said core member and a retracted position spaced from said core member to provide for stripping a molded article from said core member.

19. Apparatus as defined in claim 17 wherein said mold box includes at least one elongated core member extending within said cavity, and said article engaging means define an opening for slidably receiving said core member.

* * * * *